US008851726B2

(12) United States Patent
Matsumoto

(10) Patent No.: US 8,851,726 B2
(45) Date of Patent: Oct. 7, 2014

(54) VEHICLE LIGHTING APPARATUS

(75) Inventor: Akinori Matsumoto, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 326 days.

(21) Appl. No.: 13/288,990

(22) Filed: Nov. 4, 2011

(65) Prior Publication Data

US 2012/0113665 A1 May 10, 2012

(30) Foreign Application Priority Data

Nov. 5, 2010 (JP) ..... 2010-248012
Apr. 21, 2011 (JP) ..... 2011-094630

(51) Int. Cl.
*F21V 7/09* (2006.01)
*F21S 8/10* (2006.01)

(52) U.S. Cl.
CPC ..... *F21S 48/1172* (2013.01); *F21S 48/1382* (2013.01); *F21S 48/1388* (2013.01)
USPC ..... 362/518; 362/516; 362/539

(58) Field of Classification Search
USPC ..... 362/326–328, 341–360, 538–549, 140, 362/214–215, 516–522, 514, 507, 509
See application file for complete search history.

(56) References Cited

U.S. PATENT DOCUMENTS 3,603,928 A * 9/1971 Speedy et al. ..... 362/506
4,914,747 A * 4/1990 Nino ..... 362/539
6,543,910 B2 * 4/2003 Taniuchi et al. ..... 362/297
2003/0090905 A1 5/2003 Uchida et al.
2004/0246738 A1 * 12/2004 Taniuchi ..... 362/509
2005/0225999 A1 * 10/2005 Bucher ..... 362/539
2005/0254254 A1 * 11/2005 Moseler et al. ..... 362/520
2006/0114688 A1 * 6/2006 Takada ..... 362/518
2006/0171160 A1 8/2006 Meyrenaud et al.
2009/0097268 A1 4/2009 Mochizuki

FOREIGN PATENT DOCUMENTS

CN 1415889 A 5/2003
JP 2006216551 A 8/2006

OTHER PUBLICATIONS

English Patent Abstract of JP 2006216551, Published Aug. 17, 2006 (1 Page).
Office Action for corresponding Chinese Application No. 201110346243.7, mailed Nov. 14, 2013 (21 pages).

* cited by examiner

*Primary Examiner* — Anh Mai
*Assistant Examiner* — Fatima Farokhrooz
(74) *Attorney, Agent, or Firm* — Osha Liang LLP

(57) ABSTRACT

A vehicle lighting apparatus is provided with: a light source device including a first light source and a second light source; a reflector adapted to reflect forwardly light emitted from the light sources; a main shade adapted to shade a portion of light emitted from the first light source and reflected by the reflector; and a sub shade adapted to shade at least a portion of light emitted from the second light source and reflected by the reflector.

9 Claims, 7 Drawing Sheets

VEHICLE LIGHTING APPARATUS

BACKGROUND OF THE INVENTION

1. Field of the Invention

The present invention relates to a vehicle lighting apparatus.

2. Related Art

A headlamp for use in a vehicle is structured such that a high beam light distribution serving as a light distribution suitable for use in a normal running of the vehicle and a low beam light distribution serving as a light distribution for preventing a dazzle with respect to a vehicle running ahead or an oncoming vehicle can be switched over to each other. As a headlamp capable of switching the high beam light distribution and low beam light distribution over to each other, there is proposed a headlamp of a type that switches two light sources over to each other to thereby switch two kinds of light distribution over to each other. For example, a headlamp disclosed in Patent Document 1 uses, as a light source device, a dual filament bulb including two filaments and, by switching light emission of the two filaments over to each other, switches the high beam and low beam light distribution over to each other. Also, the headlamp disclosed in the Patent Document 1 includes an elliptic reflector for obtaining desired light distribution and a vertical reflector having a curved shape near to the arc of a parabola, and reflects lights emitted from the two reflectors to thereby obtain suitable high beam light distribution and low beam light distribution.

[Patent Document 1] JP-A-2006-216551

In the headlamp disclosed in the Patent Document 1, the elliptic reflector performs an effective function on light emitted from one of the two filaments to obtain first light distribution, while the vertical reflector performs an effective function on light emitted from the other to obtain second light distribution. Therefore, when one of the filaments, for example, the other filament emits light, the light can be projected onto the elliptic reflector formed to reflect light from one filament and, consequently, in some cases, the light of the other filament reflected by the elliptic reflector can have an unfavorable influence on the second light distribution.

SUMMARY OF THE INVENTION

One or more embodiments provide a vehicle lighting apparatus which includes two light sources and can switch two kinds of light distribution over to each other and which also can shut off light undesirable for light distribution to thereby obtain suitable light distribution. In addition, one or more embodiments provide a vehicle lighting apparatus which reuses light to be shaded for obtaining necessary light distribution in the light distribution to thereby improve the light distribution and reduce the power consumption.

In accordance with one or more embodiments, a vehicle lighting apparatus may include: a light source device including a first light source and a second light source; a reflector adapted to reflect forwardly light emitted from the light sources; a main shade adapted to shade a portion of light emitted from the first light source and reflected by the reflector; and a sub shade adapted to shade at least a portion of light emitted from the second light source and reflected by the reflector.

DETAILED DESCRIPTION OF THE EMBODIMENTS

The description of embodiments will be given below with reference to the drawings. Further, the embodiments are not intended to limit the invention but to serve as examples thereof, and all features or combinations thereof described in the embodiments are not always essential to the invention.

Embodiment 1

Figure 1:
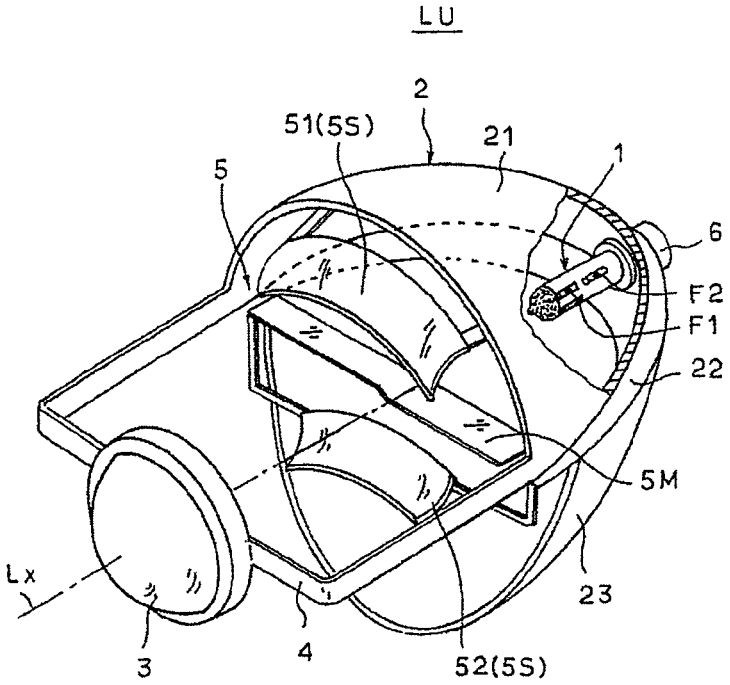
FIG. 1 is an appearance perspective view of a lamp unit according to Embodiment 1.
Figure 2:
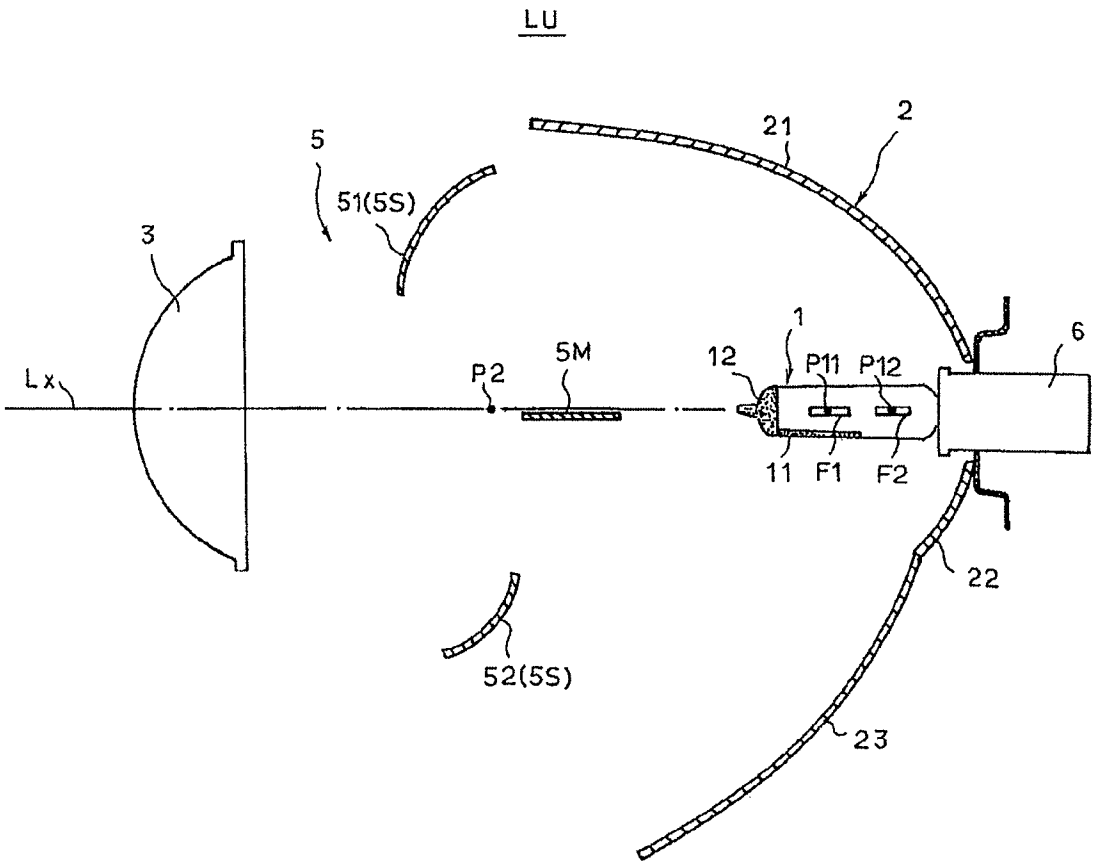
FIG. 2 is a longitudinal section view of the lamp unit according to Embodiment 1, showing an arrangement of respective parts thereof.

FIG. 1 is an appearance perspective view, showing a schematic structure of Embodiment 1. A lamp unit LU according to Embodiment 1 is mounted within a headlamp case which is not shown in FIG. 1. FIG. 2 is a longitudinal section view in which vertical surface direction positions of respective parts are shown. As shown in FIG. 2, the lamp unit LU includes a reflector 2 having a substantially container-like shape and including an inner surface serving as a light reflection surface, a bulb 1 serving as a light source device mounted at a substantially central position of the rear side surface of the reflector 2, a projection lens 3 supported at a position forwardly of the reflector 2 integrally with the reflector 2 through a frame-shaped holder 4, and a shade 5 for shading a portion of light emitted from the bulb 1. Here, a straight line, which passes through a center of the projection lens 3 and extends perpendicularly to the lens surface of the projection lens 3, is defined as a lamp optical axis Lx, while the bulb 1 is disposed on the lamp optical axis Lx.

The bulb 1 formed as the light source device of the lamp unit LU is constituted of a double filament bulb which incorporates therein two filaments F1 and F2 arranged in the lamp optical axis Lx direction. The first filament F1 situated on a leading end side of the bulb is formed as a first light source for forming low beam light distribution, while the second filament F2 on a bulb base end side is formed as a second light source for forming high beam light distribution. When the bulb 1 is mounted in the reflector 2 using a bulb socket 6, a vertical direction thereof is fixed. On the first filament F1, there is provided a lower surface inner shade 11. A surface of the lower surface inner shade 11 faces downward when the bulb 1 is mounted on the reflector 2. The lower surface inner shade 11 is coated with light-proof material. Light, which is emitted when the first filament F1 is allowed to emit light, is shaded by the lower surface inner shade 11 and is thereby prevented from being radiated more downwardly of the lamp optical axis Lx. On the leading end face of the bulb 1, there is provided a front surface inner shade 12, which is also referred to as a black top, coated with light-proof material in order to prevent the lights of the respective filaments F1 and F2 from being radiated forwardly.

The reflector 2 is generally formed in a substantially container-like shape. Specifically, the reflector 2 includes a first reflector 21 extending in an upper half section area existing upwardly of the lamp optical axis Lx, a second reflector 22 disposed in a vertically extending narrow area existing downwardly of the lamp optical axis Lx and close to the bulb 1, and a third reflector 23 disposed in a wide area existing downwardly of the lamp optical axis Lx and forwardly of the second reflector 22. That is, the first to third reflectors 21 to 23 are assembled together into an integral body, so that the reflector 2 is structured as a composite reflector.

The first reflector 21 has a shape which can be obtained when a rotation elliptic surface having the lamp optical axis Lx as its rotation axis is divided along the rotation axis into two, or a shape approximate to this shape. The first focus P11 of the ellipse is coincident with the light emitting point of the first filament F1, while the second focus P2 is coincident with the rear focus of the projection lens 3. The second reflector 22, similarly, has a shape of a portion of a rotation elliptic surface having the lamp optical axis Lx as its rotation axis, or a shape approximate to this shape, while the first focus P12 of the ellipse is coincident with the light emitting point of the second filament F2. The second focus of the second reflector 22 coincides with the second focus P2 of the first reflector 21. That is, it coincides with the rear focus of the projection lens 3. The third reflector 23 is constituted of a curved surface obtained when a portion of a parabola having the light emitting point of the second filament F2 as its focus is moved around the lamp optical axis Lx along a given locus. This given locus is a locus of a curved line or a combination of a curved line and a straight line which properly corresponds to light distribution required of the lamp unit LU. Also, the third reflector 23 is structured to extend up to an area existing downwardly of the lower end edge of the projection lens 3 which does not face the rear surface of the projection lens 3 in the lamp optical axis Lx direction.

The shade 5 includes a main shade 5M and a sub shade 5S. The main shade 5M is made of a light-proof flat plate disposed near the position of the rear focus P2 of the projection lens 3, exactly, at a position just behind the rear focus P2 in the lamp optical axis Lx direction, while the plane of the main shade 5M is fixed to and supported by the reflector 2 or a holder toward a direction along the lamp optical axis Lx. The shape of the edge portion of the leading end of the main shade 5M is not a simple straight line shape but is a shape which, in order to form a cutoff line in the low beam light distribution, corresponds to this cutoff line. In the case of the main shade 5M, in order to be able to reflect light radiated onto the surfaces thereof, that is, the upper and lower surfaces thereof are light reflection treated.

The sub shade 5S includes a first sub shade 51 disposed at a position existing backwardly of the projection lens 3 and upwardly of the lamp optical axis Lx, and a second sub shade 52 which is situated in an area existing downwardly of the lower end of the projection lens 3 in such a manner that it faces the first sub shade 51 in the vertical direction. The first and second sub shades 51 and 52 are both constituted of a concave mirror, here, a light reflection surface the section shape of which is a rotation parabolic surface shape. The respective parabolic surface focuses of the first and second sub shades 51 and 52 are set at the same position. Here, the specific dimensions and positions of the first and second sub shades 51 and 52 are not described here but will be disclosed in the description which will be given later of light distribution in the lamp turn-on time.

In the lamp unit LU having the above structure, by selecting either the first filament F1 or second filament F2 and by allowing the selected one to emit light, the low beam light distribution and high beam light distribution can be switched over to each other. That is, the first filament F1 is allowed to emit light, the light emitted from the first filament F1 is reflected by the reflector 2, and the light is then concentrated by the projection lens 3, thereby carrying out illumination under the low beam light distribution. Also, the second filament F2 is allowed to emit light, the light emitted from the second filament F2 is reflected by the reflector 2, and the light is concentrated by the projection lens 3 or the light is radiated forwardly without passing through the projection lens 3, thereby carrying out illumination under the high beam light distribution. Next, description will be given specifically of the low beam light distribution and high beam light distribution.

(Low Beam Light Distribution)

Figure 3A:
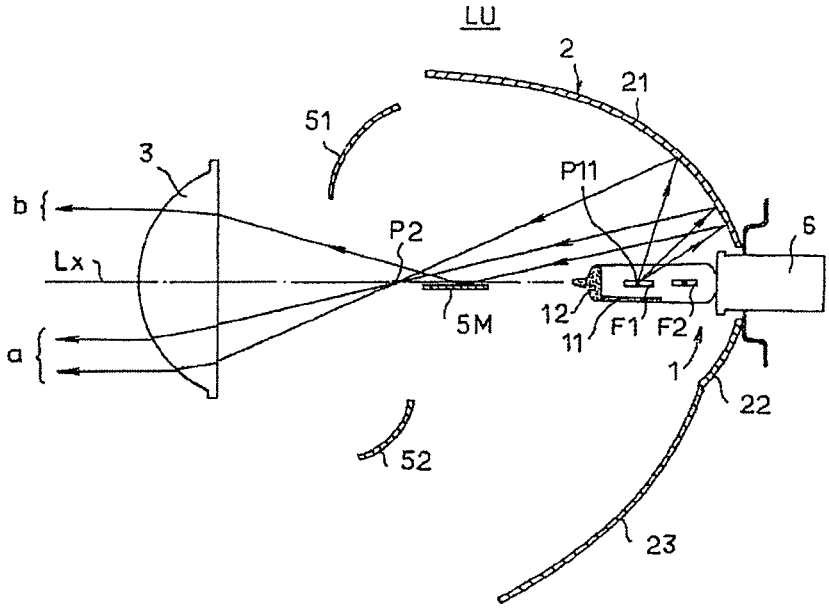
FIG. 3A is a light path view of a low beam light distribution.
Figure 3B:
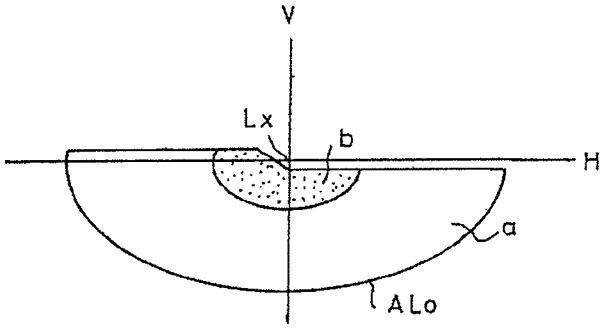
FIG. 3B is a light distribution view of the low beam light distribution.

As shown in FIG. 3A, only the first filament F1 is allowed to emit light. Of the light emitted from the first filament F1, light components radiated downwardly and forwardly are respectively shaded by the lower surface inner shade 11 and front surface inner shade 12. The light emitted upwardly from the first filament F1 is projected onto and reflected by the first reflector 21. Since the first filament F1 is situated at the first focus P11 of the first reflector 21, the light reflected by the first reflector 21 is concentrated on the second focus P2. Since the second focus P2 is the rear focus of the projection lens 3, the light concentrated on the second focus P2 and radiated onto the projection lens 3 is radiated forwardly along the lamp optical axis Lx as an illumination light a. In this case, since the main shade 5M is disposed at the second focus P2, there is shaded a portion of the light reflected by the first reflector 21, that is, the light that is radiated into the lower area of the projection lens 3 and is going to be projected from the projection lens 3 toward an area existing upwardly of the lamp optical axis Lx. Therefore, as shown in FIG. 3B, there can be obtained low beam light distribution ALo having a necessary cut line by the light a.

Here, since the surface of the main shade 5M is structured to serve as a light reflection surface, the light blocked by the main shade 5M is reflected by the upper surface of the main shade 5M and, after reflected, the light is radiated onto the upper area of the projection lens 3 to provide light b that is projected from the projection lens 3 onto an area existing slightly downwardly of the lamp optical axis Lx. This light b, as stippled in FIG. 3B, illuminates the area of low beam light distribution ALo existing near the lamp optical axis Lx, thereby enhancing the luminous intensity of this area. In this manner, in Embodiment 1, in the low beam light distribution, the light to be originally shaded by the main shade 5M can be used as the light to enhance the luminous intensity of the central area of the low beam light distribution ALo. Therefore, it is possible to prevent the lowered effective use of the light, which is emitted from the first filament F1, caused by the main shade 5M shading the same. Thus, the luminous intensity in the low beam light distribution can be increased to thereby be able to enhance the driver's visibility for an area ahead of the vehicle. Also, there can be advantageously reduced the power consumption of the headlamp when obtaining light distribution of the same luminous intensity.

(High Beam Light Distribution)

Figure 4A:
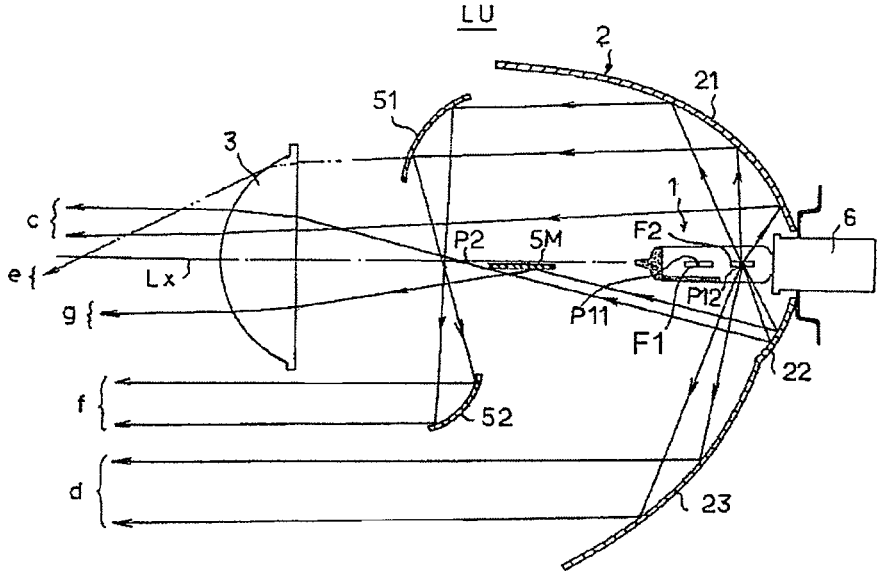
FIG. 4A is a light path view of a high beam light distribution.

As shown in FIG. 4A, only the second filament F2 of the bulb 1 is allowed to emit light. Lights respectively emitted vertically and horizontally from the second filament F2 are guided to and reflected by the first reflector 21, second reflector 22 and third reflector 23. Since the second filament F2 coincides with the first focus P12 of the second reflector 22 and the second focus P2 is the rear focus of the projection lens 3, the light reflected by the second reflector 22 is concentrated on the second focus P2 and is then radiated onto the projection lens 3, thereby providing light c which is to be emitted from the projection lens 3 in a direction along the lamp optical axis Lx. Also, since the second filament F2 coincides with the focus of the third reflector 23 as well, the light reflected by the third reflector 23 provides light d parallel to the lamp optical axis Lx. This light d is not radiated onto the projection lens 3 but is radiated forwardly as it is.

On the other hand, since the second filament F2 is situated backwardly of the first focus P11 of the first reflector 21, the light emitted from the second filament F2 and reflected by the first reflector 21 is not concentrated on the second focus P2 but is reflected toward the upper area of the projection lens 3. Since the first sub shade 51 is disposed on the rear side of the upper area of the projection lens 3, the light reflected by the first reflector 21 is radiated onto the first sub shade 51 so that the light is shaded by the first sub shade 51 and is thus not radiated onto the projection lens 3. On the other hand, since the first sub shade 51 is formed as a reflection surface, the light radiated onto the first sub shade 51 is reflected and concentrated thereby and the thus concentrated light is then radiated onto the second sub shade 52. Since the second sub shade 52 is also formed as a reflection surface, the light radiated thereon is reflected by the second sub shade 52 and is radiated forwardly along the lamp optical axis Lx. The reflected light of the second sub shade 52 provides light f that is emitted forwardly without being radiated onto the projection lens 3.

Figure 4B:
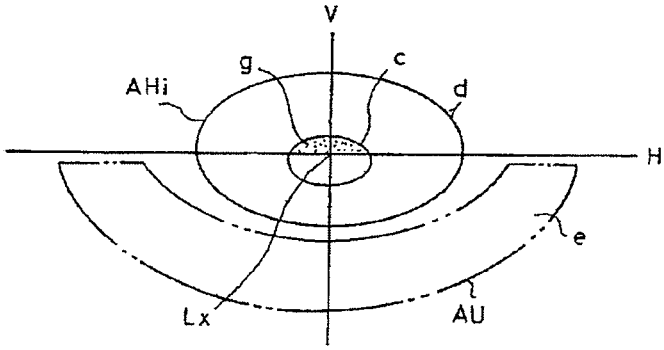
FIG. 4B is a light distribution view of the high beam light distribution in a case where a first sub shade is not provided.
Figure 4C:
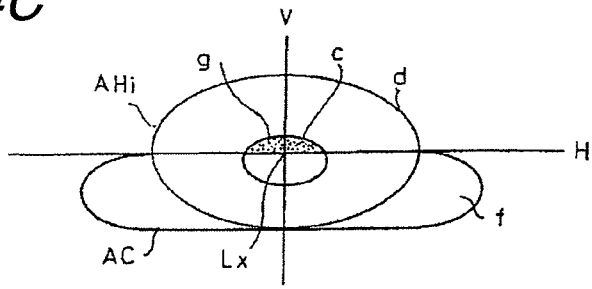
FIG. 4C is a light distribution view of the high beam light distribution, where a first sub shade is provided.

Consequently, as shown in FIG. 4B, the light c reflected by the second reflector 22 and concentrated by the projection lens 3 and the light d reflected by the third reflector 23 are allowed to illuminate an area with the lamp optical axis Lx as its center, thereby carrying out the light illumination under high beam light distribution AHi. In this case, assuming that the first sub shade 51 does not exist, as shown by a virtual line in FIG. 4A, the light reflected by the first reflector 21 is radiated onto the projection lens 3 without being shaded by the first sub shade 51, thereby providing light e which is radiated downwardly by the projection lens 3. This light e, as shown in FIG. 4B, provides the light that illuminates the lower area AU of the illumination area under the high beam lighting AHi, and the illumination light of this lower area AU is the light that illuminates an area just ahead of own vehicle. Therefore, there is a fear that the driver of own vehicle can be dazzled by this light, or, even when not dazzled, the light provides the cause of the lowered visibility of the driver for the forward distant area. In Embodiment 1, since the first sub shade 51 is disposed such that the reflected light of the first reflector 21 cannot be radiated forwardly as it is, as shown in FIG. 4B, there can be eliminated the light e for illuminating the area AU just ahead of own vehicle, thereby being able to improve the visibility of the driver. On the other hand, the reflected light of the first reflector 21 radiated onto the first sub shade 51 is reflected toward the second sub shade 52 and is then reflected by the second sub shade 52 to provide light f that is radiated forwardly. Therefore, as shown in FIG. 4C, this light f illuminates an area AC existing on the lamp optical axis Lx and slightly downwardly thereof, thereby being able to enhance the luminous intensity of the area existing ahead of own vehicle.

Also, a portion of the light reflected by the second reflector 22 is radiated onto and shaded by the lower surface of the main shade 5M. Here, since the lower surface of the main shade 5M is a light reflection surface, the above light is reflected by this lower surface and is radiated onto the lower area of the projection lens 3, thereby providing light g which is projected from the projection lens 3 onto an area existing slightly upwardly of the lamp optical axis Lx. Since this light g, as stippled in FIGS. 4B and 4C, enhances the luminous intensity of the neighboring area of the lamp optical axis Lx, it is possible to make effective use of the light that is originally shaded by the main shade 5M and is thereby wasted. This not only can enhance the visibility but also can reduce the power consumption effectively.

As can also be understood from the foregoing description, the shape, dimensions and positions of the first sub shade 51 are set such that it extends in the following area: that is, an area where the light emitted from the first filament F1 and reflected by the first reflector 21 is not prevented from entering the projection lens 3 and also where the light emitted from the second filament F2 and reflected by the first reflector 21 is allowed to enter. Also, the shape, dimensions and positions of the second sub shade 52 are set such that the light reflected light from the first sub shade 51 can be reflected forwardly without being radiated onto the projection lens 3.

Modification 1 of Embodiment 1

Figure 5:
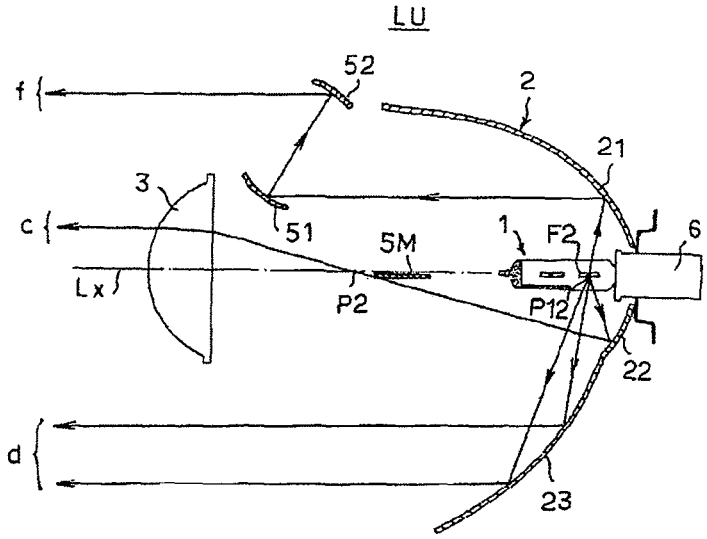
FIG. 5 is a longitudinal section view of a lamp unit according to a modification 1 of Embodiment 1, showing an arrangement of respective parts thereof.

Here, the first sub shade 51 and second sub shade 52 are not limited to the mode of Embodiment 1, provided that the above conditions can be satisfied. For example, as shown in FIG. 5, although the position of the first sub shade 51 is the same as in the above embodiment, the reflection surface thereof may be disposed to face upwardly so that the reflected light from the first reflector 21 can be reflected upwardly. The second sub shade 52 may be disposed in an area existing upwardly of the projection lens 3 such that the light to be reflected by the same can be radiated forwardly through the upper area of the projection lens 3. In the case that the second sub shade 52 is disposed in the upper area in this manner, since the second sub shade 52 does not exist in the forward area of the third reflector 23, there can be secured an increased area where the light d reflected by the third reflector 23 is radiated forwardly. This advantageously contributes to the enhancement of the luminous intensity of the light distribution or to the reduction of the size of the third reflector 23.

Modification 2 of Embodiment 1

Figure 6:
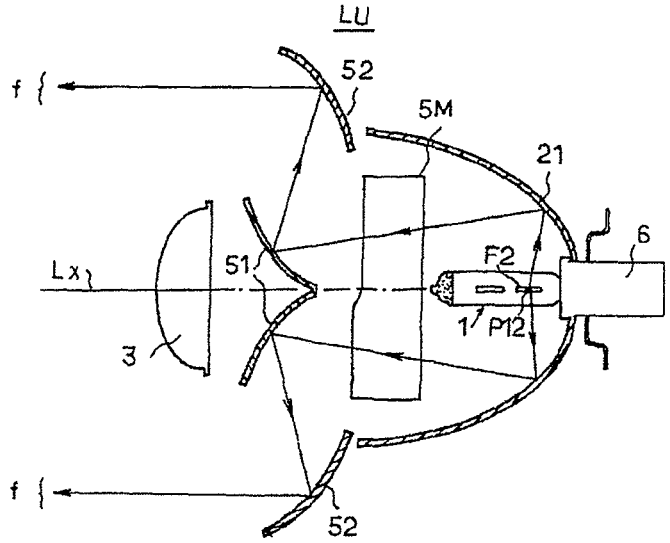
FIG. 6 is a plan view of a lamp unit according to a modification 2 of Embodiment 1, showing an arrangement of respective parts thereof.

Also, referring to the plane structure of the first sub shade 51 and second sub shade 52, as shown in FIG. 6, the first sub shade 51 may also be constituted of a pair of sub shades which are disposed at positions with the lamp optical axis Lx between them and have reflection surfaces respectively facing outwardly, while the second sub shade 52 may also be constituted of a pair of sub shades which are respectively opposed to the pair of first sub shades 51 in the right and left direction and are disposed at the right and left positions of the lamp unit LU. In the case that the second sub shades 52 are disposed right and left, the reflected light d (see FIG. 4A) from the third reflector 23 will not be shaded by the second sub shades 52, thereby being able to make effective use of the light. Also, in the case that the amounts of the lights reflected by the third reflector 23 are set equal, the height dimension of the third reflector 23 can be reduced and thus the dimension of the lamp unit LU in the vertical direction can be reduced, thereby being able to reduce the size of the headlamp unit LU.

Embodiment 2

Figure 7A:
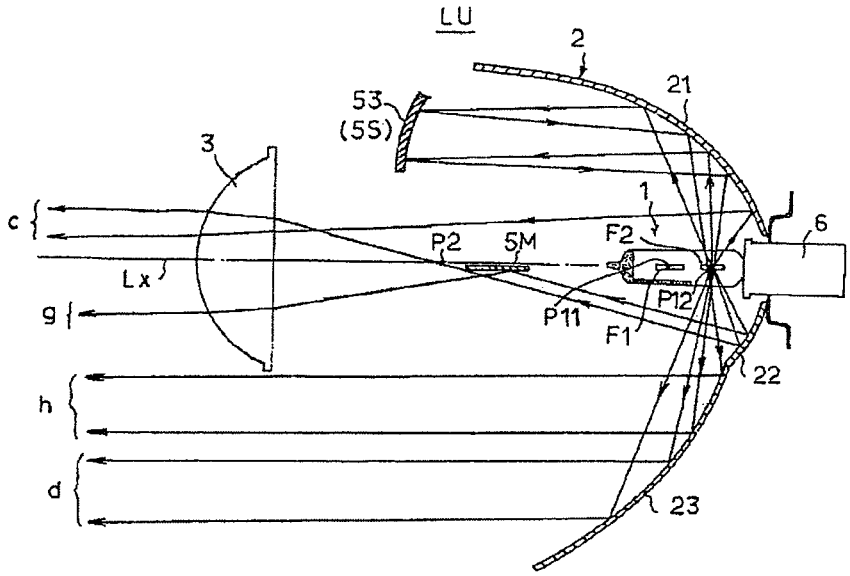
FIG. 7A is a longitudinal section view of Embodiment 2.
Figure 7B:
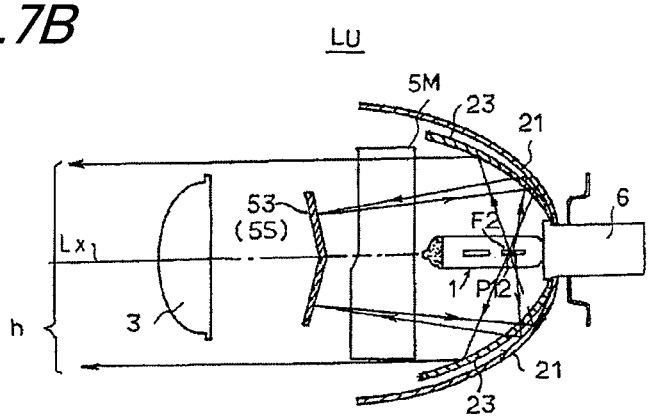
FIG. 7B is a plan view of Embodiment 2.

In Embodiment 1, the sub shade 5S is constituted of the first sub shade 51 and second sub shade 52, and the light emitted from the second filament F2 and reflected by the first reflector 21 is reflected forwardly to illuminate the forward area. Alternatively, the light emitted from the second filament F2 and reflected by the first reflector 21 may be shaded by the sub shade 5S, this light may be reflected toward the first reflector 21, and the reflected light may be superimposed on the light distribution that is used to illuminate the forward area. FIGS. 7A and 7B are respectively a longitudinal section view and a plan view of a lamp unit LU according to Embodiment 2 structured in this manner, showing the arrangement of the respective composing parts thereof. Parts equivalent to Embodiment 1 are given the same designations. In Embodiment 2, the sub shade 5S is constituted of a single sub shade 53 corresponding to the first sub shade 51 in Embodiment 1. This single sub shade 53 is here disposed at a position where the first sub shade 51 in Embodiment 1 is disposed, while the surface of the single sub shade 53 facing the bulb 1 is formed as a light reflection surface.

The light reflection surface of the single sub shade 53 is formed as a conical surface or a portion of a curved surface approximate to a conical surface, or a roof-shaped mirror surface in order that, when the light emitted from the second filament F2 and reflected by the first reflector 21 is radiated onto the single sub shade 53, the thus incident light can be reflected in a direction opposite to the incident light, that is, in the opposite direction to the incident direction, here, in a direction deviated slightly inwardly (toward the lamp optical axis Lx). Specifically, when viewed in the vertical surface direction, the light emitted from the second filament F2 and reflected by the first reflector 21 is reflected in a direction substantially along the lamp optical axis Lx; and, therefore, the vertical section of the light reflection surface of the single sub shade 52 is formed to have a flat or curved surface shape inclined slightly backwardly in order that, after the light reflected by the single sub shade 53 is reflected by the first reflector 21 and is transmitted through the second filament F2, it is allowed to enter the third reflector 23. Here, the section has a slightly dented curved surface shape. Also, since, when viewed in the plane direction, the light emitted from the second filament F2 and reflected by the first reflector 21 is reflected in a direction approaching the lamp optical axis Lx, the plane section of the light reflection surface, as shown in FIG. 7B, is formed to have a roof-shaped shape inclined outwardly at a small angle with respect to the lamp optical axis Lx in order that, after the light reflected by the single sub shade 53 is reflected by the first reflector 21 and is transmitted through the second filament F2, it is allowed to enter the third reflector 23.

With Embodiment 2, as the low beam light distribution, of course, there can be provided the same light distribution as shown in FIG. 3 of Embodiment 1. The high beam light distribution is also substantially the same as in Embodiment 1. That is, as shown in FIGS. 7A and 7B, when only the second filament F2 is allowed to emit lights, the lights emitted in the vertical and right and left directions from the second filament F2 are respectively directed toward the first reflector 21, second reflector 22 and third reflector 23 and are then reflected by the respective reflectors. Since the second filament F2 is coincides with the first focus P12 of the second reflector 22 and the second focus P2 is the rear focus of the projection lens 3, the light reflected by the second reflector 22 is concentrated on the second focus P2 and is radiated onto the projection lens 3, thereby providing the light c that is emitted from the projection lens 3 in a direction along the lamp optical axis Lx. Also, since the second filament F2 also coincides with the focus of the third reflector 23, the light reflected by the third reflector 23 provides the light d that is parallel to the lamp optical axis Lx. This light d is radiated forwardly as it is without being guided onto the projection lens 3.

Also, since the second filament F2 is situated backwardly of the first focus P11 of the first reflector 21, the light emitted from the second filament F2 and reflected by the first reflector 21 is reflected toward the upper area of the projection lens 3 without being concentrated onto the second focus P2. Since the single sub shade 53 is disposed in the rear-side upper area of the projection lens 3, the light reflected by the first reflector 21 is radiated onto this single sub shade 53, while the light is shaded by the single sub shade 53 and is thereby prevented from entering the projection lens 3. On the other hand, the light shaded by the single sub shade 53 is reflected by the light reflection surface of the rear surface of the single sub shade 53 backwardly of the lamp, that is, toward the first reflector 21 and, after then, the light is reflected by the first reflector 21 toward the second filament F2. The light radiated toward the second filament F2 passes through within the bulb 1 and is then radiated onto the third reflector 23; and, it is reflected here to provide the light h that is radiated forwardly. The reflection of the light by the single sub shade 53 and the action, in which the thus reflected light is reflected and is radiated forwardly by the third reflector 23, are carried out in the respective vertical surface and horizontal surface directions.

Figure 7C:
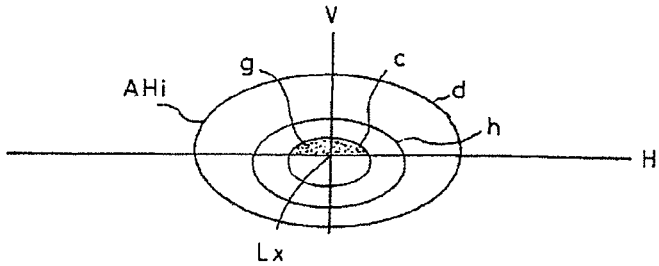
FIG. 7C is a light distribution view of Embodiment 2.

In Embodiment 2, as shown in FIG. 7C, the light c reflected by the second reflector 22 and concentrated by the projection lens 3 and the light d reflected by the third reflector 23 are allowed to illuminate an area around the lamp optical axis Lx, thereby carrying out light illumination under the high beam light distribution AHi. In this case, the light reflected by the single sub shade 53 provides the light h integrated with a portion of the light radiated downwardly from the second filament F2, that is, a portion of the light d; and, the light h is reflected and radiated forwardly by the third reflector 23. Since the light h is the light that corresponds to the reflection area of the light reflection surface of the single sub shade 53, it is a light beam narrower than the light d and also, since it is reflected in the area of the third reflector 23 existing near the lamp optical axis Lx, it is radiated onto such area of the light distribution area of the light d as exists near the optical axis. In this embodiment, since the light h is radiated onto an area narrower than the area of the light d but slightly wider than the area of the light c, the light h can enhance the luminous intensity of the neighboring area of the lamp optical axis Lx, thereby being able to enhance the visibility of the driver.

Here, in Embodiment 2 as well, since a portion of the light reflected by the first reflector 21 is shaded by the single sub shade 53 and is thereby prevented from entering the projection lens 3, there can be eliminated the light e that illuminates the lower area AU of the illumination area of such high beam light distribution AHi as shown by a chain line in FIG. 4B, that is, the area AU just ahead of own vehicle, thereby naturally being able to improve the visibility of the driver for the area existing ahead of the driver's own vehicle. Also, since the light shaded by the single sub shade 53 in this manner is reused as the light h in the high beam light distribution AHi, the power consumption of the whole lamp can be reduced effectively.

Embodiment 3

Figure 8A:
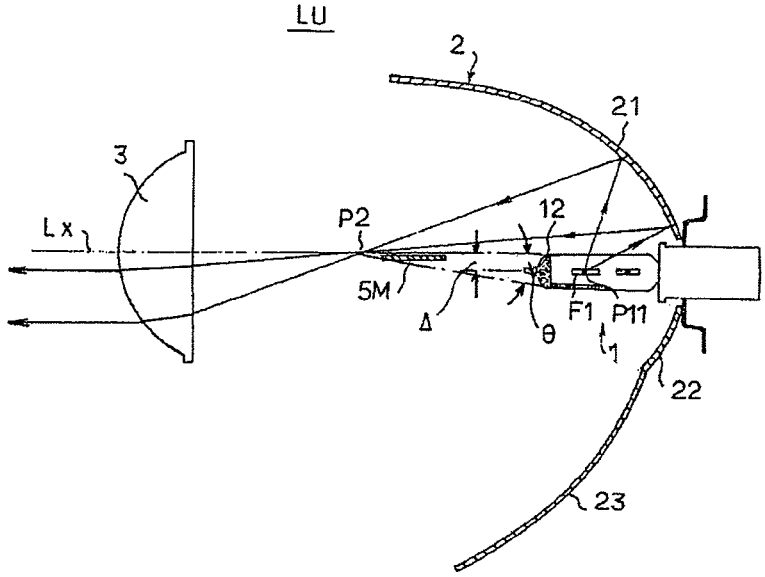
FIG. 8A is a longitudinal section view of Embodiment 3, showing arrangement positions and optical paths of the respective parts thereof.
Figure 8B:
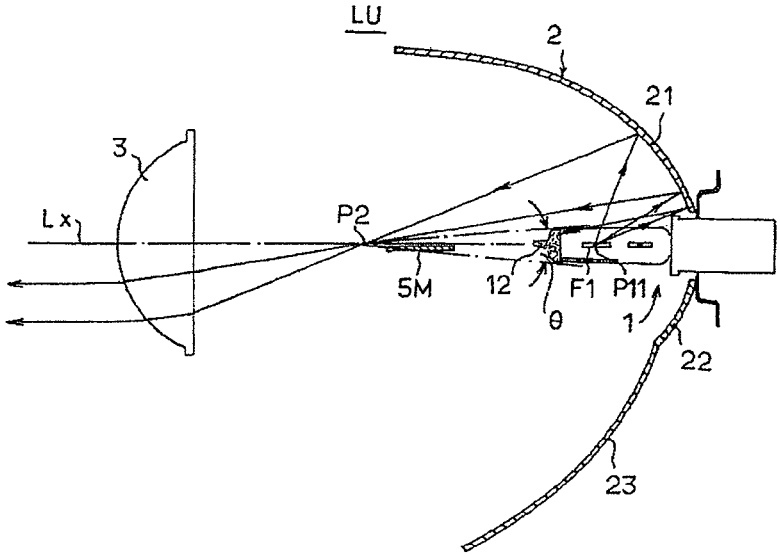
FIG. 8B is a longitudinal section view in a case where light sources position on an optical axis.

FIG. 8A is a section view of Embodiment 3, in which the same parts as in the Embodiments 1 and 2 are given the same designations. In Embodiment 3, the dimension (which is hereinafter referred to as the longitudinal dimension) of the lamp unit LU in the lamp optical axis x is shortened. In the lamp unit LU of Embodiment 1, assuming that, as shown in FIG. 8B, the distance between the reflector 2 and projection lens 3 is shortened in order to shorten the longitudinal dimension of the lamp unit LU, the front surface inner shade 12 of the bulb 1 is caused to approach the projection lens 3, thereby reducing the distance between the inner shade 12 and the rear focus of the projection lens 3 (the second focus of the reflector) P2. In Embodiment 1, since the bulb 1 is disposed on the lamp optical axis Lx, when the distance between the front surface inner shade 12 and rear focus P2 is shortened, there is increased the solid angle θ of the front surface inner shade 12 with respect to the rear focus P2. Therefore, the reflection surface area of the reflector 2 to be contained within the solid angle θ becomes a reflection invalid area. Consequently, of the light emitted from the bulb 1 and reflected by the reflector 2, the light reflected within the solid angle θ area is shaded by the front surface inner shade 12 and is not radiated forwardly any longer, thereby failing to contribute to the light distribution. Especially, in the case of the light emitted from the first filament F1, the intensity of radiation of the emission light is limited by the lower surface inner shade 11. Therefore, of the light emitted from the first filament F1, the rate of the light, which is reflected within the solid angle θ area of the first reflector 21 and is shaded by the front surface inner shade 12, increases to thereby cause the reduced luminous intensity of the light distribution and the wasteful use of the power consumption.

In order to prevent the above problems, in Embodiment 3, as shown in FIG. 8A, the center of the bulb 1 is set at a position which is shifted with respect to the lamp optical axis Lx. Here, the center of the bulb 1 is lowered downwardly by a necessary dimension Δ with respect to the lamp optical axis Lx. The lowered necessary dimension Δ is here a dimension which prevents the front surface inner shade 12 from being situated on the lamp optical axis Lx. That is, it is about half as large as the diameter dimension of the bulb 1.

In this structure, when a small-sized headlamp is formed such that the distance between the projection lens 3 and reflector 2 is reduced to thereby shorten the longitudinal dimension of the lamp unit LU, the solid angle θ area of the front surface inner shade 12 of the bulb 1 with respect to the rear focus P2 of the projection lens 3 is inclined downwardly with respect to the lamp optical axis Lx, whereby the solid angle θ area does not exist upwardly of the lamp optical axis Lx any longer. Therefore, almost all of the lights, that are emitted from the first filament F1, reflected by the first reflector 21 and concentrated on the second focus, that is, the rear focus P2 of the projection lens 3, are not shaded by the front surface inner shade 12, thereby being able to realize the reduced size of the lamp unit LU without reducing the luminous intensity of the light distribution or wasting the power consumption. Here, since the bulb 1 is lowered by a slight dimension from the lamp optical axis Lx, the center of the light distribution is lowered down slightly. However, its influence on the light distribution can be ignored.

Here, in Embodiment 3, there is illustrated an example of a bulb including a front surface inner shade. However, even in a bulb excluding a front surface inner shade, similarly, in the case that the light reflected by a reflector is radiated onto the leading end face of the bulb, the light is refracted due to the shape of this leading end face and is not concentrated on the rear focus of the projection lens, thereby causing the reduced luminous intensity of the light distribution. Therefore, even in the bulb not having the front surface inner shade, by employing a structure that the center of the bulb is shifted with respect to the lamp optical axis in the above manner, the luminous intensity of the light distribution can be enhanced and the power consumption can be reduced effectively.

In accordance with the above embodiments, a vehicle lighting apparatus may include: a light source device including a first light source and a second light source; a reflector adapted to reflect forwardly light emitted from the light sources; a main shade adapted to shade a portion of light emitted from the first light source and reflected by the reflector; and a sub shade adapted to shade at least a portion of light emitted from the second light source and reflected by the reflector.

In the above structure, a surface of the main shade may comprise a light reflection surface, and said light reflection surface of the main shade may be adapted to reflect forwardly a portion of the light reflected by the reflector.

In the above structure, the sub shade may comprise a light reflection surface, and said light reflection surface of the sub shade may be adapted to reflect forwardly light incident on said light reflection surface of the sub shade.

In the above structure, the sub shade may comprise a light reflection surface, and said light reflection surface of the sub shade may be adapted to reflect light incident on said light reflection surface of the sub shade toward the reflector.

The vehicle lighting apparatus may further include a projection lens adapted to concentrate the light reflected by the reflector. The light sources may be disposed downwardly of a center line of the projection lens.

In the above structure, the light source device may be constituted of a double filament bulb including a first filament serving as the first light source and a second filament serving as the second light source.

In the above structure, the double filament bulb may include a lower surface inner shade, and the lower surface inner shade may be adapted to shade a part of light emitted from the first light source so as to prevent said part of the light emitted from the first light source from being radiated more downwardly of a lamp optical axis.

In the above structure, the main shade may have an edge adapted to form a cutoff line in a light distribution formed by the vehicle lighting apparatus.

According to the above structure, due to provision of the sub shade for shading a portion of the light emitted from the second light source and reflected by the reflector, when obtaining high beam light distribution using the light emitted from the second light source, it is possible to shut off the reflected light of the reflector for illuminating an area just ahead of own vehicle, whereby the degraded visibility caused by the illumination of the just ahead area can be improved.

In addition, according to the above structure, the surface of the main shade is formed as a light reflection surface and a portion of the light reflected by the reflector is reflected forwardly by this light reflection surface, whereby the thus reflected light can enhance the luminous intensity of the partial area of the light distribution. This can advantageously enhance the visibility of a driver for an area existing ahead of the driver's own vehicle and can make effective use of the light to thereby save the power consumption. Further, according to the above structure, the sub shade is formed as a light reflection surface and the sub shade is structured such that it reflects the light to be shaded forwardly or toward the reflector, whereby the light to be shaded by the sub shade can be radiated directly or after it is reflected again by the reflector to superimpose the light on the light distribution to thereby enhance the luminous intensity of the light distribution, so that the characteristics of the light distribution can be improved and the power can be used effectively. Also, according to the above structure, since the light sources are shifted downwardly of the center line of the projection lens, the light sources can be disposed near the projection lens without shutting off the reflected light of the reflector by the light source device. This can shorten the dimension of the lighting apparatus in the optical axis direction and thus the size of the lighting apparatus can be reduced.

Although, in the above embodiments, the invention is applied to a lamp unit including a double filament bulb, the invention can also be applied similarly to a headlamp structured such that two independent bulbs are disposed in the lamp optical axis direction and the on and off of these bulbs are switched over to each other to thereby switch the light distribution. Also, the structures of the reflectors in the above embodiments are not limitative, that is, the structures of the first to third reflectors are not limited to those employed in the above embodiments.

It goes without saying that the vehicle lighting apparatus according to the invention can be applied not only to a headlamp for use in a four-wheel vehicle but also to a headlamp for use in a two-wheeled vehicle such as a motorcycle.

INDUSTRIAL APPLICABILITY

The invention can be applied to a vehicle lighting apparatus structured such that two light sources are switched over to each other to thereby obtain different kinds of light distribution.

DESCRIPTION OF REFERENCE NUMERALS AND SIGNS

LU: Lamp unit
1: Bulb
2: Reflector
3: Projection lens
4: Holder
5: Shade
5M: Main shade
5S: Sub shade
6: Bulb socket
11: Lower surface inner shade
12: Front surface inner shade
21: First reflector
22: Second reflector
23: Third reflector
51: First sub shade
52: Second sub shade
53: Single sub shade
F1: First filament
F2: Second filament
P11, P12: First focus
P2: Second focus
Lx: Lamp optical axis

What is claimed is:

1. A vehicle lighting apparatus, comprising:
a light source device including a first light source and a second light source;
a reflector device that reflect forwardly light emitted from the light sources;
a main shade that shades a portion of light emitted from the first light source and reflected by the reflector device;
a sub shade that shades at least a portion of light emitted from the second light source and reflected by the reflector device; and
a projection lens,
wherein the reflector device comprises a first reflector, a second reflector, and a third reflector,
wherein the first reflector is disposed such that a first focus thereof is positioned at a light emitting point of the first light source, and a second focus thereof is positioned at a rear focus of the projection lens,
wherein the second reflector is disposed such that a first focus thereof is positioned at a light emitting point of the second light source, and a second focus thereof is positioned at the rear focus of the projector lens,
wherein the third reflector is disposed such that a focus thereof is positioned at the light emitting point of the second light source, and
wherein light emitted from the first light source forms a low bream light distribution pattern, and light emitted from the second light source forms a high beam light distribution pattern.

2. The vehicle lighting apparatus according to claim 1,
wherein a surface of the main shade comprises a light reflection surface, and
wherein said light reflection surface of the main shade reflects forwardly a portion of the light reflected by the reflector device.

3. The vehicle lighting apparatus according to claim 1,
wherein the sub shade comprises a light reflection surface, and
wherein said light reflection surface of the sub shade reflects forwardly light incident on said light reflection surface of the sub shade.

4. The vehicle lighting apparatus according to claim 1,
wherein the sub shade comprises a light reflection surface, and
wherein said light reflection surface of the sub shade reflects light incident on said light reflection surface of the sub shade toward the reflector device.

5. The vehicle lighting apparatus according to claim 1,
wherein the projection lens concentrates the light reflected by the reflector device, and
wherein the light sources are disposed downwardly of a center line of the projection lens.

6. The vehicle lighting apparatus according to claim 1, wherein the light source device is constituted of a double filament bulb including a first filament serving as the first light source and a second filament serving as the second light source.

7. The vehicle lighting apparatus according to claim 6,
wherein the double filament bulb includes a lower surface inner shade, and
wherein the lower surface inner shade shades a part of light emitted from the first light source so as to prevent said part of the light emitted from the first light source from being radiated more downwardly of a lamp optical axis.

8. The vehicle lighting apparatus according to claim 1, wherein the main shade has an edge that forms a cutoff line in a light distribution formed by the vehicle lighting apparatus.

9. A vehicle lighting apparatus, comprising:

a light source device including a first light source and a second light source;

a reflector device that reflects forwardly light emitted from the light sources;

a main shade that shades a portion of light emitted from the first light source and reflected by the reflector device;

a sub shade that shades at least a portion of light emitted from the second light source and reflected by the reflector device; and a projection lens that concentrates the light reflected by the reflector device, wherein a surface of the main shade comprises a light reflection surface, and wherein said light reflection surface of the main shade reflects forwardly a portion of the light reflected by the reflector device, wherein the sub shade comprises a light reflection surface, and said light reflection surface of the sub shade reflects light incident on said light reflection surface of the sub shade forwardly or toward the reflector device, wherein the light sources are disposed downwardly of a center line of the projection lens, wherein the light source device is constituted of a double filament bulb including a first filament serving as the first light source and a second filament serving as the second light source, wherein the double filament bulb includes a lower surface inner shade, wherein the lower surface inner shade shades a part of light emitted from the first light source so as to prevent said part of the light emitted from the first light source from being radiated more downwardly of a lamp optical axis, and wherein the main shade has an edge forms a cutoff line in a light distribution formed by the vehicle lighting apparatus, wherein the reflector device comprises a first reflector, a second reflector, and a third reflector, wherein the first reflector is disposed such that a first focus thereof is positioned at a light emitting point of the first light source and a second focus thereof is positioned at a rear focus of the projection lens, wherein the second reflector is disposed such that a first focus thereof is positioned at a light emitting point of the second light source, and a second focus thereof is positioned at the rear focus of the projector lens, wherein the third reflector is disposed such that a focus thereof is positioned at the light emitting point of the second light source, and wherein light emitted from the first light source forms a low bream light distribution pattern, and light emitted from the second light source forms a high beam light distribution pattern.

* * * * *